United States Patent [19]

Habermehl et al.

[11] 4,329,141

[45] May 11, 1982

[54] METHOD OF AND DEVICE FOR HEATING FINELY DIVIDED SOLID PARTICLES IN CONVEYING DUCTS

[75] Inventors: Diethard Habermehl; Werner Kucharzyk, both of Essen, Fed. Rep. of Germany

[73] Assignees: Bergwerksverband GmbH; Didier Engineering GmbH, both of Essen, Fed. Rep. of Germany

[21] Appl. No.: 201,325

[22] Filed: Oct. 27, 1980

[30] Foreign Application Priority Data

Nov. 2, 1979 [DE] Fed. Rep. of Germany ..... 2944383

[51] Int. Cl.[3] ..... F27B 15/18; F27D 7/00; F27B 15/00

[52] U.S. Cl. ..... 432/17; 432/25; 432/58

[58] Field of Search ..... 432/14, 17, 25, 58; 34/57 A

[56] References Cited

U.S. PATENT DOCUMENTS

| | | | |
|---|---|---|---|
| 2,666,632 | 1/1954 | Culver et al. | 432/58 |
| 2,813,351 | 11/1957 | Godel | 34/57 A |
| 2,903,800 | 9/1959 | Skoglund | 34/57 A |
| 3,178,830 | 4/1965 | Mark | 34/57 A |
| 3,584,849 | 6/1971 | Cremer et al. | 432/25 |
| 4,241,513 | 12/1980 | Rohde | 432/14 |

*Primary Examiner*—John J. Camby
*Attorney, Agent, or Firm*—Michael J. Striker

[57] ABSTRACT

In a pneumatic conveying heater or drier for dispersed solid particles, a pulsating device in the form for example of a rotary throttling disk is arranged in the circulation conduit for the conveying stream of hot gas so as to periodically accelerate and decelerate the conveyed solid particles, thus increasing the efficiency of the heat transfer.

6 Claims, 1 Drawing Figure

METHOD OF AND DEVICE FOR HEATING FINELY DIVIDED SOLID PARTICLES IN CONVEYING DUCTS

BACKGROUND OF THE INVENTION

The present invention relates in general to pneumatic conveying heaters, and in particular to a method of and a device for increasing the efficiency of heating finely divided solid particles in pneumatic conveying ducts wherein in a known manner a stream of hot conveying gas entrains at a lower zone of the duct dispersed solid particles to convey the same upwardly to a classifying device.

The heat treatment of finely divided solid particles is frequently carried out in the so-called pneumatic conveying heaters. The pneumatic conveying heater consists usually of an upright conveying and heating duct in which the finely divided solid particles are entrained in a stream of a hot gas and conveyed upwardly, whereby a heat transfer from the gas to the solid particles takes place. At the upper end of the conveying duct, the gases and the solid particles are separated from each other, usually by means of a cyclone. Hot gases, also called heat carrying gases or conveying gases, needed for this process are usually generated in a furnace or combustion chamber and are mixed with exhaust gases separated at the upper end of the conveying duct to such a degree that the conveying gas attains the desired temperature and volume. Thereupon, the hot gas is fed into the lower inlet of the upright conveying duct and entrains the solid particles which are dispersed into the duct downstream of the inlet opening.

The conveying ducts of the above described type can be assembled in one stage or in several stages and are applicable for example in drying and preheating of coking coal. In this case, the moisture of the coal is initially reduced at most about 10% and subsequently the coal particles are heated to about 150°-250° C.

The disadvantage of known pneumatic conveying heaters is the fact that the effectiveness of the heat transfer from the conveying gas to the solid particles attains its maximum value only in the acceleration phase of the stream travel, inasmuch as, due to the high speed difference between the heat carrying gas and the solid particles resulting in this acceleration phase, the solid particles are subject to an intensive circumcirculation. After the acceleration phase the effectiveness of the heat transfer sharply drops because of the subsequent very small speed differences. It has been necessary, therefore, to form relatively high pneumatic conveying ducts in order to obtain a sufficient duration of the gas stream action necessary for transferring heat from the carrier gas to the solid particles.

SUMMARY OF THE INVENTION

It is therefore a general object of the present invention to overcome the aforementioned disadvantages.

More particularly, an object of the invention is to provide an improved method of and a device for increasing effectiveness of the heat transfer from the heat carrying gas to the dispersed solid particles so as to enable a shorter construction of the pneumatic conveying duct.

An additional object of this invention is to provide such an improved method and device which reduce the construction cost of the pneumatic conveying and heating structure.

A further object of the invention is to provide such an improved pneumatic conveying heater having a high heat transfer rate over the entire length of the gas conveying duct.

Still another object of this invention is to provide such an improved pneumatic conveying heater which prevents overheating of small dispersed particles relative to the larger ones.

In keeping with these objects, and others which will become apparent hereinafter, one feature of the invention resides, in a method in which a stream of hot gas is fed into an upright duct, and the finely divided solid particles are dispersed into a lower zone of the duct to be conveyed upwardly to a classifying device, in the provision of a pulsating gas stream so that the conveyed solid particles are periodically accelerated and decelerated during the upward movement.

The device of this invention comprises an upright conveying duct having a lower inlet and an upper outlet, means for feeding a stream of a hot gas into the inlet, means for dispersing the solid particles in the lower zone of the duct, and pulsating means arranged in the gas feeding means for periodically accelerating and decelerating the gas stream and thus the movement of the particles.

The finely divided solid particles suitable for the heat treatment in the conveying duct can have the size up to 10 mm. Usually, the treated solid particles do not have completely uniform sizes but include a spectrum of sizes differing by up to two powers-of-ten. In conventional pneumatic conveying apparatuses of this kind, the flow speeds of the air-locked solid particles after completing a relatively short acceleration interval do not differ substantially one from another, so that the duration of the heat treatment of the largest particles and of the smallest ones is not too different.

Surprisingly, it has been found that when the heat carrying gas is made to pulsate two effects occur which substantially improve the effectiveness of such pneumatic conveying devices:

Firstly, the deceleration or braking and the subsequent acceleration of the solid particles continuously changes the relative speed between the heat carrying gas and the solid particles. As a consequence, the heat transfer rate is considerably improved so that under suitable conditions the desired final temperature of the solid particles is obtained already after the completion of one third of the length of travel which has been necessary in the conventional pneumatic conveying ducts. In other words, the length of the conveying duct can be made substantially shorter than in prior-art devices. Alternatively, by virtue of the improved heat transfer, it is also possible to preserve the same length of the duct which is hitherto necessary in conventional devices whereby the temperature of the heat carrying gas at the inlet of the conveying duct can be substantially reduced. In this manner, any overheating of a part of the dispersed solid particles, particularly of the smallest ones, can be effectively avoided, and consequently the heat treatment according to the method of this invention is more economical than that of prior art.

Secondly, the braking and acceleration of the solid particles due to the pulsation of the heat carrying gas stream varies according to the size of the particles, namely smaller particles due to their inferior inertia follow the speed variations of the gas stream faster than larger particles. Accordingly, the changes of the relative speed between the carrying gas and the solid particles are smaller for small-size particles than for the larger ones and consequently the heat transfer rate for the small particles is less than for the large ones. This feature also contributes to the prevention of overheating even of the minute fractions of individual finely divided particles, and a perfectly uniform heating of the dispersed solid material irrespective of the size of the individual particles, is achieved.

The method of this invention is carried out preferably by means of a pulsating device arranged in a supply conduit for the heat carrying gas stream. The installation of this pulse generating device can be made at different points of the gas stream circuit. It is only of importance that the pulsating device influence the main part of the heat carrying gas stream and that it be installed outside the zone of the gas conveying duct where the actual heat transfer during the conveying takes place. For example, the pulsating device can be arranged at the bottom end of the upright pneumatic conveying duct upstream of the intake port for the solid particles. It is also possible, however, to arrange the pulsating device in a conduit into which the gases to be combusted in the combustion chamber are fed or in a conduit for exhaust gases and vapors which are employed for admixing to the heat carrying gas in a corresponding mixing chamber. The last mentioned two possibilities have the advantage that the pulsating device is subject to a much reduced thermal load. As a rule, it is necessary to select those conduits in the circulating system which conduct a major part of the gas stream so that the generated pulsation be sufficiently strong to influence the final heat carrying gas stream.

It is particularly advantageous when the pulsating device is arranged in the range of the gas circulating system where the separation of vapors and gases from the heated solid particles at the output end of the conveying duct takes place. In this manner, the entire stream of the conveying gas is influenced by the pulsating device without subjecting the latter to the temperature of the hot gas stream.

The pulsating device itself can be constructed in different ways, for example in the form of a movable diaphragm which changes according to a predetermined frequency the cross section of the gas circulating circuit.

Another possibility is the provision of a throttling disk which is arranged in the conduit circuit of the heating system and rotatable about an axis to control the effective cross section of the assigned conduit in response to its angular position. The axis of rotation of the throttling disk extends preferably perpendicularly to the longitudinal axis of the conduit so that the throttling disk is operated in a very simple manner by external driving means.

Independently from the structure of the pulsating device, it is also possible to control the cross section of the conduit according to different waveforms such as for instance according to a sine wave, sawtooth wave or steplike wave. Such forms of the pulsations, the frequency of which can be freely selected, are generated by suitably control the driving means for the diaphragm or throttling disk.

In a modification, it is also possible to create a throttling disk which is supported for rotation about an axis extending transversely to the longitudinal axis of the assigned gas conduit, whereby the throttling disk has the shape of an aerodynamic rotor which is driven by the conveying hot gas itself. Such an embodiment of the pulsating device operates without outer driving means. The shape, the bearings and the velocity of the hot gas stream determine a certain natural frequency and usually give rise to a sinusoidal pulsation of the gas stream.

It has proven to be particularly advantageous when the throttling disk is arranged concentrically in the assigned conduit whereby an annular air gap is left between the periphery of the disk and the inner wall of the conduit. The size of this air gap determines the amount of a gas stream which passes through the conduit even if the throttling disk of the pulsating device is in its closing position in which it counteracts the gas stream with its maximum surface. The air gap around the throttling disk reduces the resistance and thus the corresponding driving power for circulating the hot gas stream. Simultaneously due to the larger air gap, the effect of pulsations on the smaller solid particles will be less than on the larger ones.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figures 1, 2:
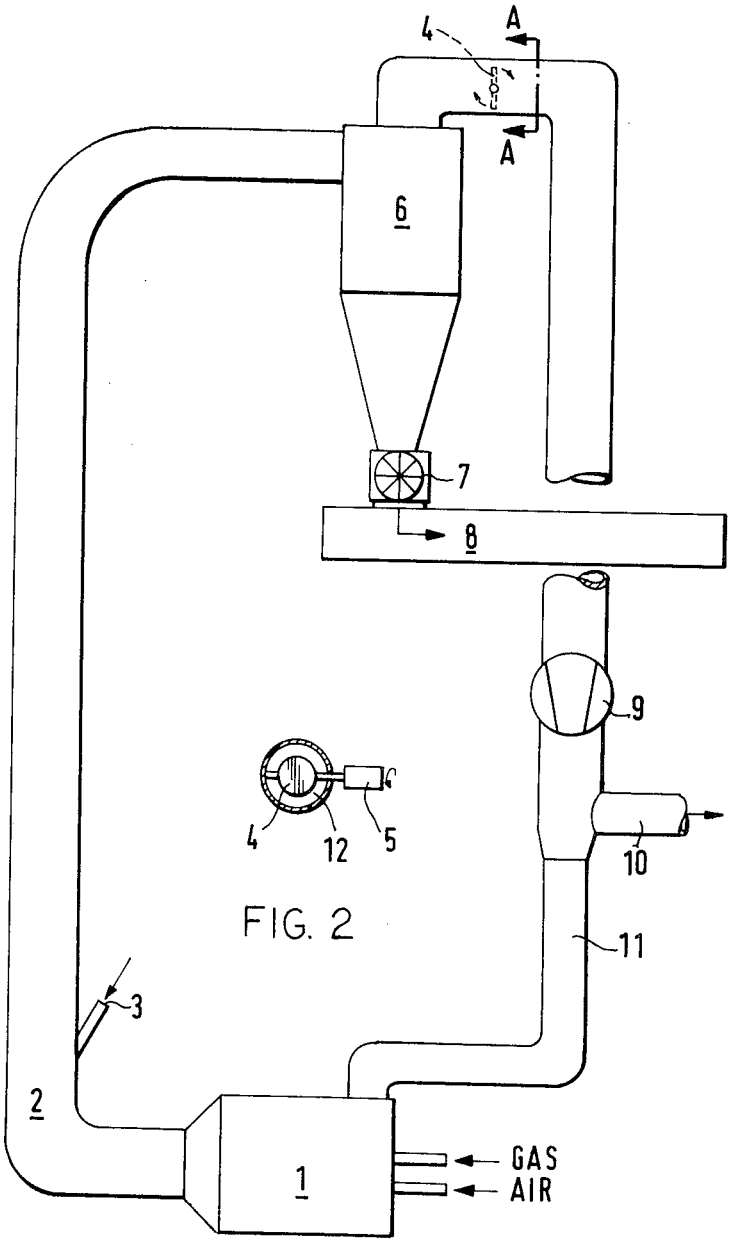
FIG. 1 shows a schematic diagram of one embodiment of a pneumatic heater system of this invention.
FIG. 2 is a sectional side view of a part of the system of this invention, taken along the line A—A.

Hot conveying gas is generated by firing combustible gases in a combustion chamber or furnace 1 where also exhaust vapors or gases from a return conduit 11 are admixed. The generated stream of hot gas is fed to an inlet opening at the bottom of an upright conveying duct 2. Downstream of the inlet is an intake port for finely divided solid particles 3 which are fed into the conveying duct 2 for being entrained in the stream of the hot conveying gas, accelerated and conveyed upwardly.

A separation cyclone 6 is arranged at the outlet opening of the duct 2 for separating the solid particles from the conveying gas. Heat treated solid particles are discharged through an air lock 7 and taken over by a conveying device 8. The exhaust gas or vapors from the separating cyclone 6 pass through a pulsating device 4 and a subsequent blower 9. At the outlet of the blower 9, the exhaust gas is branched into a conduit 10 from which a part of the exhaust gas is discharged into the outer atmosphere, whereas the other part of the exhaust gas and vapors is fed via a return conduit 11 into the combustion chamber 1.

In this example, the pulsating device 4 includes a throttling disk mounted on a shaft arranged transversely to the axis of the exhaust conduit. The axis projects through the exhaust conduit and is rotated together with the throttling disk by a power drive 5. The throttling disk 4 is concentric with the cross section of the exhaust conduit and its diameter is smaller than that of the latter, so that an annular air gap 12 will result between the periphery of the throttling disk and the inner wall of the conduit.

The throttling disk is rotated by the drive 5, for example according to a sine function, to expose a maximum and a minimum of its surface against the gas stream circulating in the pneumatic heater system. For instance, the rotational rate of the throttling disk is about 300 rotations per minute, resulting in a pulsation frequency of 10 cycles per second.

Due to the pulsation of the circulating hot gas, the individual solid particles at the minimum speed amplitude of the hot gas exhibit also a certain loss of their speed depending on their inertia, whereas during the maximum amplitude of the gas speed a renewed acceleration of the particles takes place. This acceleration is also a function of the inertia of the respective particles.

The advantages of this invention will now be explained by way of an example of drying and preliminary heating of coke coal particles:

An upright gas conveying duct of 30 meters in length for drying and preliminary heating of ground coke coal is equipped at its top with a separation cyclone and in the exhaust gas conduit at the outlet of the cyclone is provided with a rotary throttling disk according to this invention. The frequency of pulsation of the hot conveying gas is 10 cycles per second, and the speed of the gas is between 10 and 30 meters per second. The diameter of the gas conveying duct is 0.45 meters, the amount of the gas stream is 3.2 $m^3$/second, the throttling disk of the pulsating device has a diameter of 0.366 meters, the width of the air gap between the throttling disk and the inner wall of the gas conveying duct is 0.042 meters, the size of particles is between 0 and 10 mm, and the weight rate of flow of the conveyed particles is 2.8 kg/sec.

The above pneumatic conveying heater according to this invention is compared in the following table with a comparable conventional heater without the use of pulsating device. The speed of conveying hot gas is kept constant at 30 meters/second.

| | Prior art gas conveying heater: | Gas conveying heater according to this invention: |
|---|---|---|
| Average retention time of a coal particle in the conveying duct | 2.03 sec. | 6.68 sec. |
| product of relative speed and the retention time | 30.9 meters | 106.7 meters |

The time interval of contact or the length of path in which a coal particle is in contact with the hot conveying gas is several times increased by the method or device of this invention. It is evident that pneumatic conveying heaters equipped with the pulsating device of this invention can have a correspondingly shorter heating duct for attaining the same effect as conventional heaters of this kind.

It will be understood that each of the elements described above, or two or more together, may also find a useful application in other types of constructions differing from the types described above.

While the invention has been illustrated and described as embodied in a pneumatic conveying heater or drier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of heating finely divided solid particles, comprising the steps of feeding a stream of hot gas into an upright duct; dispersing said particles into said stream in a lower zone of said duct; conveying said particles by said stream upwardly to an upper zone of said duct; separating the heat treated particles in the upper zone from the gas stream; and pulsating the separated gas stream in the upper zone so as to periodically accelerate and decelerate the gas stream with entrained solid particles in said duct whereby the heat transfer rate is increased.

2. A device for heating finely divided solid particles in an upright conveying duct having a bottom inlet and a top outlet, comprising means for feeding a stream of a hot gas into said bottom inlet; means for dispersing the solid particles in a lower zone of said duct to convey said particles by said stream toward said top outlet; a separating cyclone arranged at said top outlet of the duct for separating said gas stream from the heat treated particles; said cyclone having a separated gas outlet; and pulsating means provided at said gas outlet of said cyclone for periodically decelerating and accelerating the separated gas stream and thus the stream of hot gas with conveyed solid particles in said duct.

3. A device as defined in claim 2, wherein said gas feeding means includes a gas circulation conduit connected to said gas outlet and said pulsating means comprises a throttling disk supported in said conduit for rotation about an axis which is transversely directed to the longitudinal axis of said conduit.

4. A device as defined in claim 3, wherein said throttling disk is in the form of an aerodynamical rotor driven by said gas stream.

5. A device as defined in claim 3, wherein said throttling disk is mounted on an axle projecting from said conduit and rotated by a power drive.

6. A device as defined in claim 3, wherein said throttling disk is concentric with the axis of said conduit and has a diameter which is smaller than that of said conduit to define an annular air gap between its periphery and the inner wall of said conduit.

* * * * *